United States Patent [19]

Yasuhisa

[11] 4,257,027

[45] Mar. 17, 1981

[54] TRANSFORMER BOBBIN ASSEMBLY

[75] Inventor: Saburo Yasuhisa, Tokyo, Japan

[73] Assignee: Shimoda Electric Company, Tokyo, Japan

[21] Appl. No.: 40,574

[22] Filed: May 21, 1979

[30] Foreign Application Priority Data

Nov. 27, 1978 [JP] Japan ..... 53-146268

[51] Int. Cl.[3] ..... H01F 15/10; H01F 27/30

[52] U.S. Cl. ..... 336/192; 336/208

[58] Field of Search ..... 336/192, 198, 208, 209; 310/194; 242/118.41

[56] References Cited

U.S. PATENT DOCUMENTS

| | | | |
|---|---|---|---|
| 1,360,753 | 11/1920 | Johannesen | 336/198 X |
| 3,652,968 | 3/1972 | Johnston et al. | 336/208 X |
| 3,781,741 | 12/1973 | Weiner | 336/198 X |
| 3,946,350 | 3/1976 | Goto | 336/208 |
| 4,027,279 | 5/1977 | Shigehana | 336/198 X |
| 4,095,206 | 6/1978 | Hishiki | 336/192 X |

FOREIGN PATENT DOCUMENTS

| | | | |
|---|---|---|---|
| 2311612 | 9/1973 | Fed. Rep. of Germany | 336/208 |

*Primary Examiner*—Thomas J. Kozma

*Attorney, Agent, or Firm*—Darby & Darby

[57] ABSTRACT

A transformer bobbin assembly comprising in combination an outer frame bobbin having outer frame flanges integrally secured thereto at both axial ends of an inner drum thereof, on which a primary coil is arranged, an inner frame bobbin having inner frame flanges integrally secured thereto at both axial ends of an outer drum thereof, on which a secondary coil is arranged, said outer drum of said inner frame bobbin being located in coaxial alignment with the inner drum of the outer frame bobbin so that the inner frame bobbin is mounted over the outer frame bobbin so as to surround the same. Protection covers are secured to the outer frame bobbin to cover the primary and secondary coils as well as the connected portions of the lead wires thereof to the outside circuit.

In a modified embodiment of the transformer bobbin assembly the inner frame bobbin is constructed of two bobbin segments which have a U shaped configuration, said bobbin segments being adapted to be displaced toward each other so as to be joined together to build an inner frame bobbin and thus surround the outer frame bobbin between the bobbin segments.

6 Claims, 5 Drawing Figures

TRANSFORMER BOBBIN ASSEMBLY

BACKGROUND OF THE INVENTION

The present invention relates to a transformer bobbin assembly which is constructed such that a constant distance between the primary and secondary coils is ensured along the extending surfaces thereof, connecting pins and lead wires of the respective coils are arranged in a rational manner. The simplified construction, assembly and interconnection of wires to the transformer.

Hitherto, electrical insulation between the primary and secondary coils have been ensured by locating a web of insulating paper having heat resistance therebetween. Lately there has been proposed an improved structure of transformer bobbin assembly which is constructed such that an intermediate bobbin made of heat resistant plastic material is superimposed over a bobbin on which the primary coil is mounted and then the secondary coil is arranged on said intermediate bobbin.

Among the disadvantages of the conventional transformer bobbin assembly are that the both bobbins are insufficiently joined, the bobbin structure becomes complicated, if more rigid one is required, and the distance between the primary and secondary coils is maintained only with inexactness along the extending surfaces thereof. Moreover it is recognized as another disadvantage that less consideration is taken into the arrangement of connecting pins and lead wires and connecting operations require substantial man-hours.

SUMMARY OF THE INVENTION

Thus the present invention has been invented in view of the drawbacks with the conventional transformer bobbin assembly as mentioned above.

It is a main object of the invention to provide a transformer bobbin assembly in which a constant distance between the primary and secondary coils is satisfactorily ensured along the extending surfaces thereof.

It is other object of the invention to provide a transformer bobbin assembly in which the connecting pins and lead wires of the respective coils are located and arranged in a rational manner and connecting operations are performed with substantially improved productivity.

It is another object of the invention to provide a transformer bobbin assembly which is simple in structure and easily to be assembled in less time length.

Other objects and advantageous features of the invention will be readily understood from the following description taken in connection with the drawings which illustrate preferred embodiments thereof.

To realize the aforesaid objects there is proposed in accordance with the invention a new and unique transformer bobbin assembly which is constructed of an outer frame bobbin having outer frame flanges integrally secured thereto at the both axial ends of an inner drum thereof, on which a primary coil is arranged, an inner frame bobbin having inner frame flanges integrally secured thereto at the both axial ends of an outer drum thereof, on which a secondary coil is arranged, said outer drum of the inner frame bobbin being located in coaxial alignment with the inner drum of the outer frame bobbin so that the inner frame bobbin is mounted over the outer frame bobbin so as to surround the same, and protection covers secured to the outer frame bobbin to cover the primary and secondary coils as well as the connected portions of the lead wires thereof to the outside circuit.

In a modified embodiment of the invention there is proposed that the inner frame bobbin is constructed of two bobbin segments which have a U shaped configuration wherein said bobbin segments are adapted to be displaced toward each other so as to be joined together and thus surround the outer frame bobbin between the bobbin segments.

BRIEF DESCRIPTION OF THE ACCOMPANYING DRAWINGS

Now the present invention will be described in detail with reference to the accompanying drawings which illustrate preferred embodiments of the invention, in which.

DETAILED DESCRIPTION OF THE INVENTION

Figure 1:
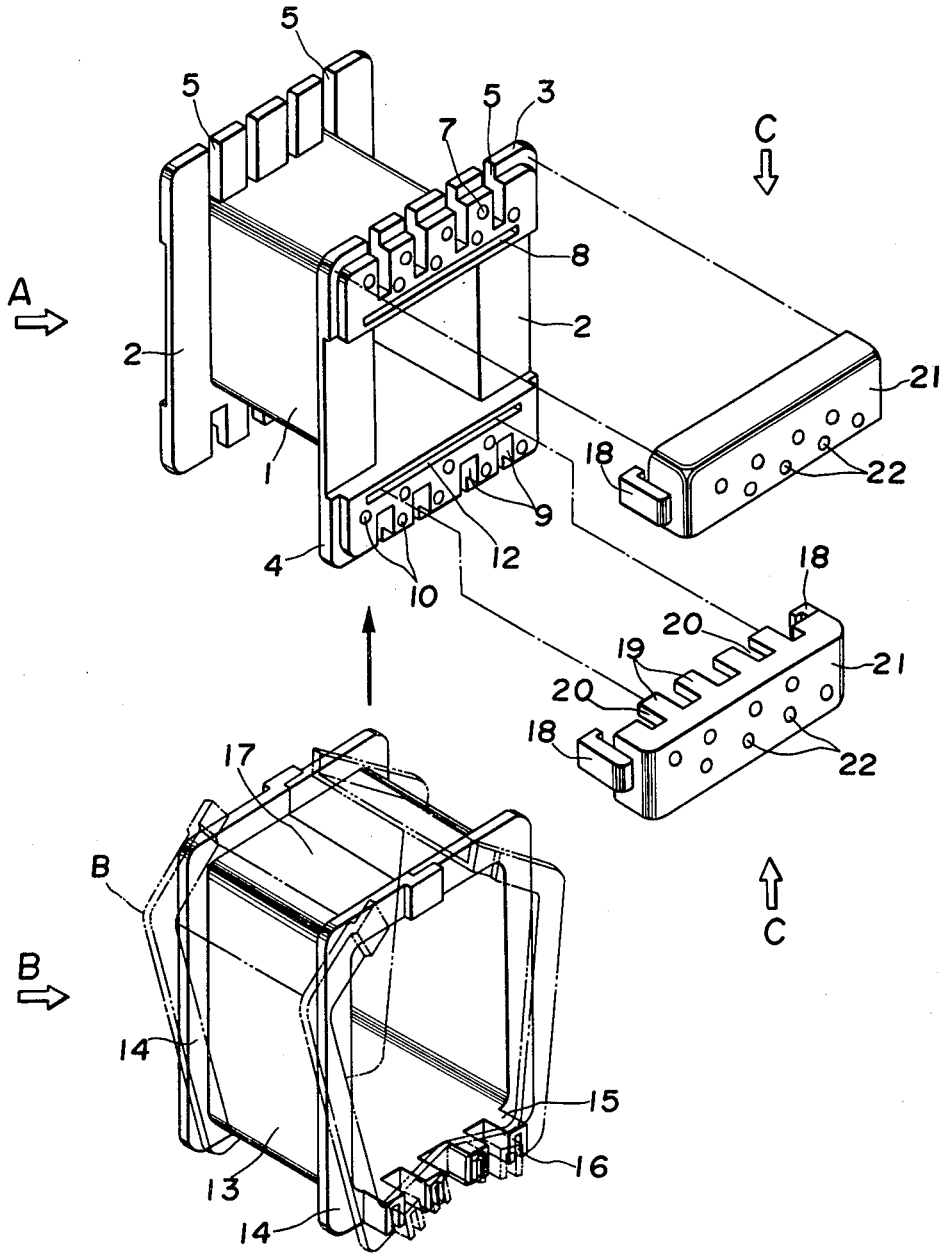
FIG. 1 is a perspective view of a transformer bobbin assembly in accordance with an embodiment of the invention, wherein three components thereof, that is, outer frame bobbin, inner frame bobbin and protection covers are shown as disassembled in a spaced relation.
Figure 2:
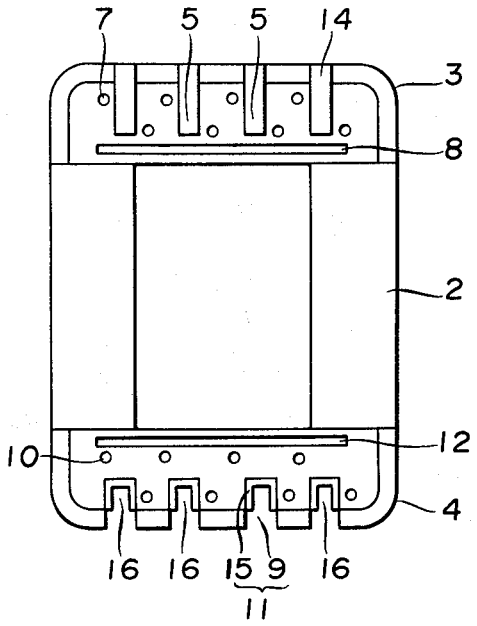
FIG. 2 is a front view of the transformer bobbin assembly, wherein the outer and inner frame bobbins are assembled.
Figure 3:
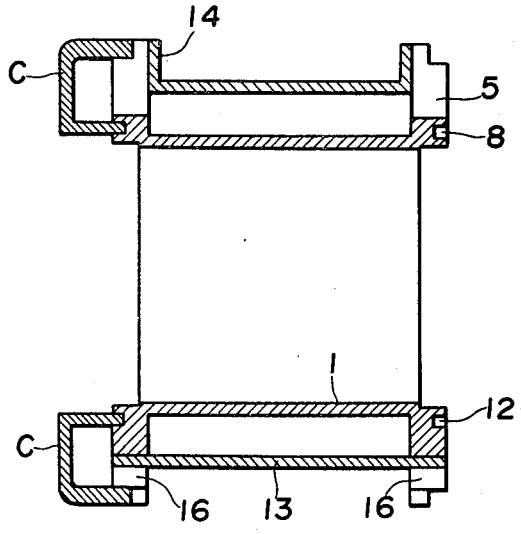
FIG. 3 is a sectional view of the transformer bobbin assembly taken along the center line after completion of assembling, wherein coil windings are eliminated for the purpose of simplification of illustration.

A transformer bobbin assembly in accordance with the present invention is constructed of an outer frame bobbin A on which a primary coil P is mounted, an inner frame bobbin B which is fit over said outer frame bobbin A and on which a secondary coil S is mounted and two protection covers C secured to the outer frame bobbin A.

The outer frame bobbin A comprises an inner drum 1 having a substantially square section and two outer frame flanges 2 securely disposed on the both axial ends of said inner drum 1, said outer frame flange 2 having a first connecting piece 3 and a second connecting piece 4, both of which form a lateral portion of said outer frame flange 2 with a heavy thickness. The first connecting piece 3 is provided with a plurality of slots 5 and a plurality of pin holes 7 in a closely spaced relation, the former serving for extension of lead wire P1 of the primary coil P, while the latter serving for connection of pin 6 to the outside circuit such as power supply system or the like (not shown). Each pair of pin hole 7 are located in an oblique arrangement relative to the adjacent slots 5 so that lead wires P1 extending through the respective slots 5 don't come in contact with each other. Moreover the first connecting piece 3 is formed with an engagement slit 8 into which a plurality of engagement tongues 19 of the protrusion cover C are plunged.

The second connecting piece 4 located opposite to the first connecting piece 3 and is formed with a number of engagement grooves 9 into which the corresponding protrusion 15 of the inner frame bobbin B is adapted to be inserted and on both sides of said engagement groove 9 are provided pin holes 10 through which connecting pin 6 extends for connection of lead wire S1 of the secondary wire S to the outside circuit such as load or the like (not shown). These pin holes 10 are also disposed in an oblique arrangement in the same manner as the pin holes 7 so that the connecting pins 6 are spaced from each other to ensure insulation therebetween. As mentioned above, into said engagement groove 9 is inserted the protrusion 15 of the inner frame bobbin B, through which the lead wire S1 of the secondary coil S is adapted to extend outward from the inside thereof. Hence the protrusion 15 and engagement groove 9 form an engagement portion between the outer frame bobbin A and inner frame bobbin B and further serves for guiding outward extension of the lead wire S1 of the secondary coil S. In the meantime, the second connecting piece 4 is also formed with an engagement slit 12 in the same manner as the aforesaid first connecting piece 3, into which a plurality of engagement tongues 19 of the protection cover C are inserted.

The inner frame bobbin B is made of flexible insulating material and constructed of an outer drum 13 and two inner frame flanges 14 integrally disposed at both ends of said outer drum 13. The outer drum has such a substantial square section as to surround the aforesaid inner drum 1, while the inner frame flange 14 is formed with a plurality of protrusions 15 for engagement with the grooves 9 at the lower portion thereof. Further the engagement protrusion 15 is formed with a groove 16 on the outer face thereof, which serves for guiding therethrough the extension of the lead wire S1 of the secondary wire S on the outer drum 13.

As apparent from FIG. 1, the outer drum 13 of the inner bobbin B is slit along the line 17 for the whole axial length thereof so that the inner bobbin B can be expanded at the slit 17. Specifically the outer drum 13 can be extended outwards rotatably about the portion of the outer drum 13 located opposite to said slit 17 as a center of rotation, as illustrated in phantom lines in FIG. 1, resulting in an enlarged opening through which the inner drum 1 of the outer frame bobbin A is inserted. Thus the inner drum 1 of the outer frame bobbin A and the outer drum 13 of the inner frame bobbin B are arranged in coaxial alignment. It should be emphasized as an advantageous feature with the transformer bobbin assembly of the invention that after the inner drum 1 of the outer frame bobbin A is inserted in place on said enlarged opening, the slit portion 17 of the outer drum 13 is closed owing to its own restorable resilience. It is to be added that the distance between the both inner frame flanges 14 is determined narrower than that of the outer frame flange 2.

Figure 5:
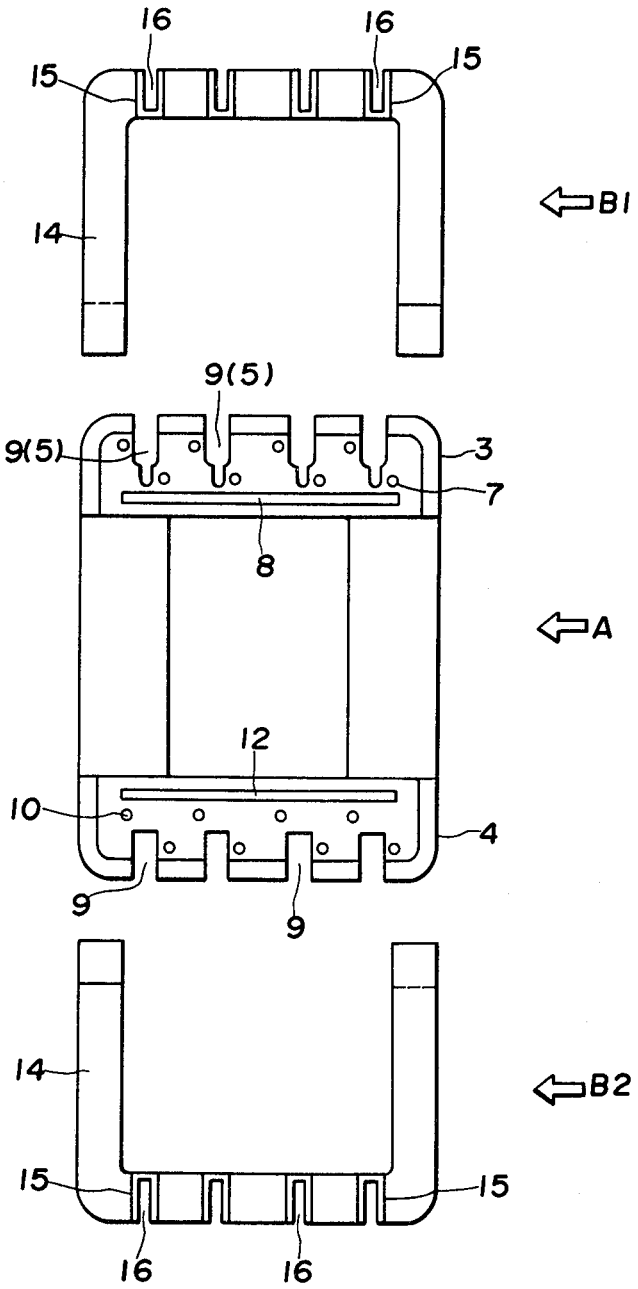
FIG. 5 is a front view of the transformer bobbin assembly in accordance with another embodiment of the invention, wherein the components, that is, outer and inner frame bobbins are shown as disassembled in a spaced relation.

With respect to the inner frame bobbin B it is possible construct it in such a manner that the outer frame bobbin A is placed between two bobbin segments comprising the first bobbin B1 and the second bobbin B2, each of which has a configuration in the form of character U, as illustrated in FIG. 5. In this embodiment the first and second bobbin segments B1 and B2 are provided with the engagement protrusions 15 respectively, each of which is formed with the guide groove 16, while the outer frame bobbin A is provided with the first and second connecting pieces 3 and 4, the former being formed with engagement slots 9 through which the lead wires P1 and S1 are adapted to extend outwards, pin holes 7 and an engagement slit 8 and the latter being also formed with engagement grooves 9, pin holes 10 and an engagement slit 12 in the same manner as the aforesaid first connecting piece 3.

The protection cover C made of flexible material is constructed in the form of box, which is dimensioned so as to be correctly engaged with the first and second connecting pieces 3 and 4. Further the protection cover C is provided with engagement protrusions 18 at both lateral ends thereof, by means of which the connecting pieces 3 and 4 are engaged with the corresponding protection cover C respectively. Moreover the protection cover C is formed with a plurality of engagement tongues 19 which are adapted to be inserted in the engagement slits 8 and 12 and a plurality of guide slots 20 through which the lead wire extends coming from the outside circuit such as power supply system, load or the like for making a connection with the connecting pin 6. In addition the protection cover C is formed with a plurality of through holes 22 on the base portion thereof, which are located to correspond to the pin holes 7 and 10 on the connecting pieces 3 and 4.

In assembling the transformer bobbin of the invention, first the primary coil P is wound about the inner drum 1 of the outer frame bobbin A and then the lead wire P1 of said primary coil P is extended through the slot 5 to be connected to the pin 6. Next, the inner frame bobbin B is expanded along the slit line 17, the outer frame bobbin A is inserted in the enlarged opening of the inner frame bobbin B with its lower protrusions 15 engaged into the grooves 9 and then the expanded inner frame bobbin is allowed to restore the original state, whereby the inner drum 1 of the outer frame bobbin A is surrounded by the outer drum 13 of inner frame bobbin B. Then the secondary coil S is wound about the outer drum 13 and its lead wire S1 is extended through the groove 16 of protrusion 15 of the inner frame bobbin B and further through the second connecting piece 4 of the outer frame bobbin A to be connected to the pin 6. As required, the lead wire coming from the outside circuit is connected to the respective pins 6, then the protection covers C are engaged to the connecting pieces 3 and 4 of the outer frame bobbin A and thereafter all of the connecting pins 6 are coated with insulating material.

Figure 4:
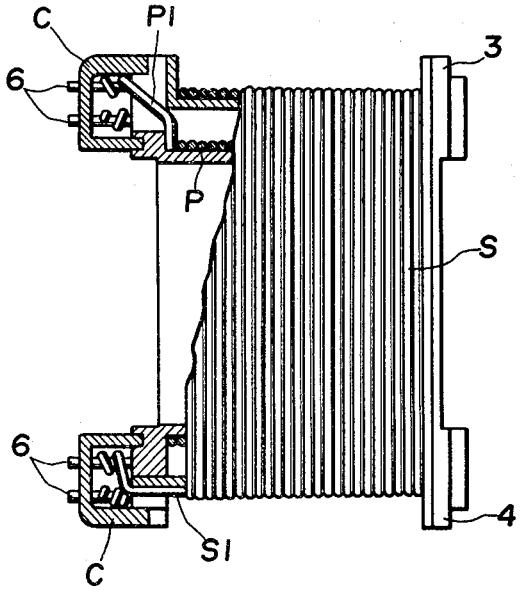
FIG. 4 is a side view of the transformer assembly which is ready to be operated, a portion thereof being cut away.

In FIG. 4 the primary and secondary coils P and S are shown as a single layer of winding, but it should be understood that the present invention is not limited within this embodiment of coil structure.

As described in the above embodiments of the invention, the pin holes 7 and 10 in the first and second connecting pieces 3 and 4 are located in an oblique arrangement in a spaced relation between the adjacent slots 5 or grooves 9 so as to insure space between the connecting pins 6. Thus there occurs no contact between the lead wires P1 of the primary coil P or between the lead wires S1 of the secondary coils S so that very high safety of operation is insured.

As mentioned above and illustrated in FIG. 1, the inner frame bobbin B is made of flexible material so that the outer frame bobbin A is inserted within the enlarged opening of the inner frame bobbin B with the aid of its flexibility and restorability. Thus the transformer bobbin assembly can be assembled in a one step operation, resulting in reduced man-hour required for assembling operation and improved productivity. It is to be noted that the inner frame bobbin B as illustrated in FIG. 1 may be more preferable than that in FIG. 5 particularly in respect of storage, packing or the like, because the former is constructed of less number of parts or members than the latter.

In addition, since the engagement protrusion 15 of the inner frame bobbin B serves not only for operating as an engagement portion 11 at which the inner and outer frame bobbins A and B are connected, but also as a guide means 16 for the lead wire of the secondary coil S. Hence a very rational and useful structure will be insured for the transformer bobbin assembly.

Moreover the protection cover C is connected to the inner frame bobbin A not only by way of the engagement protrusions 18 but also by way of the engagement tongues 19 which are inserted into the engagement slit 8. Thus connection therebetween is reliable without any danger of disconnection of the former from the latter and moreover without any possibility of electrical trouble caused by invasion of dust, contact of finger or the like, because the connecting pins 6, the lead wires P1 and S1 and connected portions of the lead wires are completely covered.

Additionally, owing to the arrangement of the guide slot 20 through which the lead wire is extended, wiring operation is carried out in the optimum manner. This enables the soldering operation for the lead wires to be carried out within the protection cover C without any exposure of the soldered portions to the outside.

Further the through holes 22 on the base portion 21 of the protection cover C are located in position corresponding to the pin holes on the inner frame bobbin A. This helps stabilize the extension of the end portion of the connecting pins 6 and moreover ensures direct mounting of the transformer bobbin assembly on a base board with excellent stability.

Since the transformer bobbin assembly of the invention is constructed such that the primary and secondary coils are mounted in a spaced relation by means of the outer drum 13 of the inner frame bobbin B, satisfactory distance therebetween is ensured along the extending surfaces thereof, causing any trouble such as lost resistivity against voltage or the like to be completely prevented.

Further, owing to the rational arrangement of the connecting pins 6 and the slots 5 as well as the grooves 16 for the lead wires P1 and S1 of the coils P and S, connecting operation is carried out in an effective and convenient manner, whereby remarkably improved productivity is ensured.

In addition, owing to the arrangement of the protection cover C, unpleasant appearance is avoided, which is brought about by protection of connected portions and their exposure to the outside. Thus wiring operation is carried out in perfect order.

Moreover, owing to the very simple structure of the transformer bobbin assembly, it is easily assembled with a substantially reduced man power.

As mentioned above, the transformer bobbin assembly in accordance with the present invention has a variety of advantages including a constant distance between the primary and secondary coils is ensured along the extending surfaces thereof, connecting and wiring operations are carried out in a simplified manner, the structure thereof is simple and mass production is possible to be effected.

Thus the present invention has been described particularly with reference to the preferred embodiments thereof but it should be understood that the same may be changed or modified without any departure from the spirit and scope of the invention.

What is claimed is:

1. A transformer bobbin assembly comprising:

an outer frame bobbin having an inner drum on which a primary coil is arranged and outer frame flanges formed integrally with the inner drum at both ends of the inner drum, said outer frame flanges having guide slots or grooves through which the lead wires of primary and secondary coils are extended axially of said outer bobbin, at least one of said outer frame flanges having pin holes into which connecting pins are inserted to interconnect said primary and secondary coils with an outside circuit, said slots or grooves and said pin holes being located in a closely spaced relation, an inner frame bobbin having an outer drum on which a secondary coil is arranged and inner frame flanges formed integrally with the outer drum at both ends of the outer drum, said inner frame flanges having guide grooves through which lead wires of the secondary coil are extended axially of said inner bobbin, said outer drum of the inner frame bobbin being located in coaxial alignment with the inner drum of the outer frame bobbin so that the outer drum surrounds the inner drum, said inner frame flanges being positioned at the inside of the outer frame flanges, and protection covers attached to the outside of the at least one outer frame flange to cover connected portions of the lead wires of said primary and secondary coils to the outside circuit.

2. A transformer bobbin assembly as set forth in claim 1, wherein the inner frame bobbin is made of flexible material and slit over the whole axial length thereof to be restorably expanded outwards so that the inner drum of the outer frame bobbin is inserted in the enlarged opening of the inner frame bobbin, which is caused by the aforesaid expansion.

3. A transformer bobbin assembly as set forth in claim 1, wherein the outer and inner frame bobbins are engaged to each other by means of engagement portions which are formed in place on said outer and inner frame bobbins.

4. A transformer bobbin assembly as set forth in claim 1, wherein the protection covers are formed with guide slots through which the lead wires of the outside circuit are extended to make a connection to the respective primary and secondary coils.

5. A transformer bobbin assembly as set forth in claim 1, wherein the inner frame bobbin is composed of two bobbin segments which have a U shaped configuration, said bobbin segments being displaced toward each other so as to be joined together to build an inner frame bobbin and surround the outer frame bobbin therebetween.

6. A transformer bobbin assembly as set forth in claim 5, wherein the bobbin segments are provided with engagement protrusions respectively, each of which is formed with a guide groove through which the lead wires of the secondary coil are extended.

* * * * *